US008051837B2

(12) United States Patent
Choi

(10) Patent No.: US 8,051,837 B2
(45) Date of Patent: Nov. 8, 2011

(54) INTAKE MANIFOLD FOR VEHICLE AND INTAKE SYSTEM INCLUDING THE SAME

(75) Inventor: Jae Seok Choi, Anyang-si (KR)

(73) Assignees: Hyundai Motor Company, Seoul (KR); Kia Motor Corporation, Seoul (KR)

( * ) Notice: Subject to any disclaimer, the term of this patent is extended or adjusted under 35 U.S.C. 154(b) by 151 days.

(21) Appl. No.: 12/572,855

(22) Filed: Oct. 2, 2009

(65) Prior Publication Data

US 2010/0139602 A1 Jun. 10, 2010

(30) Foreign Application Priority Data

Dec. 5, 2008 (KR) ..... 10-2008-0123639

(51) Int. Cl.
*F02M 35/10* (2006.01)

(52) U.S. Cl. ..... 123/468; 123/184.21; 123/195 A; 123/198 D

(58) Field of Classification Search ..... 123/468, 123/469, 470, 184.21, 184.61, 193.5, 195 A
See application file for complete search history.

(56) References Cited

U.S. PATENT DOCUMENTS

| | | | | |
|---|---|---|---|---|
| 5,630,387 | A * | 5/1997 | Kamiyama | 123/184.38 |
| 6,532,928 | B2 * | 3/2003 | Ogata | 123/184.61 |
| 6,776,132 | B2 * | 8/2004 | Kudo et al. | 123/184.42 |
| 7,210,461 | B2 * | 5/2007 | Schreeck et al. | 123/468 |
| 2008/0202472 | A1 * | 8/2008 | Whatley et al. | 123/469 |
| 2009/0241886 | A1 * | 10/2009 | Kameda | 123/184.21 |

FOREIGN PATENT DOCUMENTS

| | | | |
|---|---|---|---|
| JP | 2-305356 | A | 12/1990 |
| JP | 2004-278509 | A | 10/2004 |
| JP | 2005-083247 | A | 3/2005 |
| JP | 2005-220792 | A | 8/2005 |
| JP | 2007-191029 | A | 8/2007 |
| KR | 10-2005-0050157 | A | 5/2005 |

* cited by examiner

*Primary Examiner* — Hai Huynh
(74) *Attorney, Agent, or Firm* — Morgan, Lewis & Bockius LLP

(57) ABSTRACT

An intake system of an engine for a vehicle, may include a surge tank including a first flange, and an intake manifold including a second flange connected with the first flange of the surge tank, wherein the intake manifold may include a main body including a fuel rail and intake ports corresponding to cylinders, and a guide member provided on the main body to guide the surge tank coupled with the main body in a direction where the surge tank becomes separated and more distant from the fuel rail of the intake manifold when a vehicle collision occurs.

13 Claims, 5 Drawing Sheets

INTAKE MANIFOLD FOR VEHICLE AND INTAKE SYSTEM INCLUDING THE SAME

CROSS-REFERENCE TO RELATED APPLICATION

The present application claims priority to Korean Patent Application Number 10-2008-123639, filed on Dec. 5, 2008, the entire contents of which application is incorporated herein for all purposes by this reference.

BACKGROUND OF THE INVENTION

1. Field of the invention

The present invention relates to an intake manifold for a vehicle and an intake system including the same, and more particularly, to an intake manifold for a vehicle and an intake system including the same, which can prevent damage of a fuel rail when vehicle collision occurs.

2. Description of Related Art

Generally, an intake system of an engine for a vehicle serves to guide external air into each combustion chamber in each cylinder. The external air guided into each combustion chamber is mixed with fuel being supplied from a fuel system, the fuel mixed with the external air is burnt, and the resultant exhaust gas is discharged to an outside through an exhaust system.

Here, the intake system is composed of a surge tank, and an intake manifold formed with intake ports which are fixed to the surge tank by bolts and correspond to the respective cylinders.

In front and in the rear of the intake manifold, fuel rails for supplying fuel to the respective cylinders are mounted.

According to the conventional intake system as described above, however, the connection force between the serge tank and the intake manifold, which are connected together by bolts, is insufficient, and when vehicle collision occurs, the engine is pushed toward a dash panel, so that the dash panel hits the surge tank due to its repelling force to make the surge tank separate from the intake manifold.

Accordingly, the surge tank hits the fuel rail positioned in front of the intake manifold to damage the fuel rail.

In order to solve this problem, a scheme for increasing the number of bolts may be proposed to strengthen the connection force between the surge tank and the intake manifold. However, in the case of increasing the number of bolts, the manufacturing cost is increased and the system structure is complicated.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an intake manifold for a vehicle and an intake system including the same, which can prevent the damage of a fuel rail when vehicle collision occurs, without increasing the manufacturing cost and with the system structure simply implemented.

The intake manifold of an engine for a vehicle may include a main body including a fuel rail and intake ports corresponding to cylinders, and a guide member provided on the main body to guide a structure coupled with the main body in a direction where the structure becomes separated and more distant from the fuel rail when vehicle collision occurs, wherein the guide member is installed at a predetermined angle of inclination on a flange formed at an upper portion of the main body.

The guide member may be installed along a front portion of the flange in a forward direction of the vehicle, wherein the guide member installed on the flange is disposed in front of a front lower portion of the structure and a top portion of the guide member is disposed higher than the front lower portion of the structure so that the structure moves along the guide member upwards when the vehicle collision occurs and wherein a top portion of the guide member is disposed higher than the fuel rail.

The guide member installed on the flange may be disposed in front of a front lower portion of the structure and a top portion of the guide member is disposed higher than the front lower portion of the structure so that the structure moves along the guide member upwards when the vehicle collision occurs.

A top portion of the guide member may be disposed higher than the fuel rail.

The fuel rail may be positioned lower than the flange, and the guide member is upwardly inclined against the flange.

In another aspect of the present invention, the intake system of an engine for a vehicle, may include a surge tank including a first flange, and an intake manifold including a second flange connected with the first flange of the surge tank, the intake manifold including a main body including a fuel rail and intake ports corresponding to cylinders, and a guide member provided on the main body to guide the surge tank coupled with the main body in a direction where the surge tank becomes separated and more distant from the fuel rail of the intake manifold when a vehicle collision occurs, wherein the guide member is installed at a predetermined angle of inclination on the second flange formed at an upper portion of the main body, wherein the guide member installed on the second flange of the intake manifold is disposed in front of a front lower portion of the first flange of the surge tank and a top portion of the guide member is disposed higher than the front lower portion of the first flange so that the surge tank moves along the guide member upwards when the vehicle collision occurs, wherein the fuel rail is positioned lower than the second flange, and the guide member is upwardly inclined against the second flange in a forward direction of the vehicle, wherein the guide member is installed along a front portion of the second flange in a forward direction of the vehicle, wherein a top portion of the guide member is disposed higher than the fuel rail, and wherein the surge tank and the intake manifold are fastened by fastening members in predetermined positions.

With the above-described construction, the surge tank, which separates from the intake manifold when vehicle collision occurs, is guided to become more distant from the fuel rail, and thus the damage of the fuel rail can be prevented.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
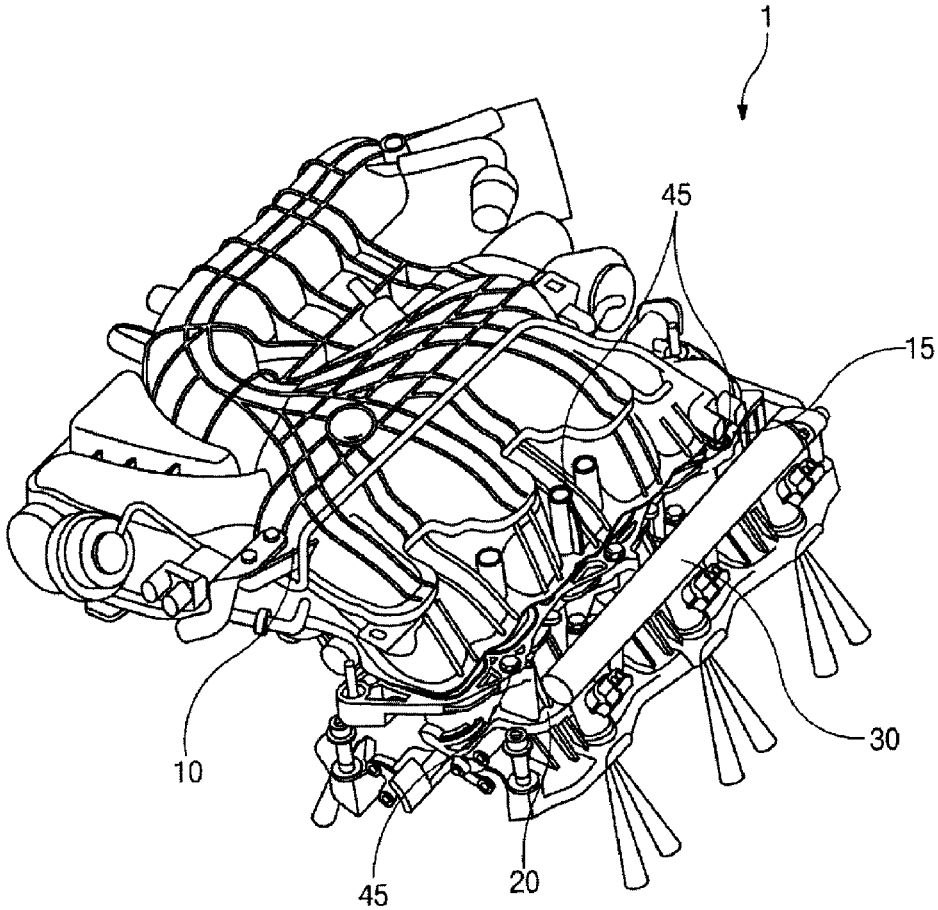
FIG. 1 is a perspective view illustrating an exemplary intake system of an engine for a vehicle according to the present invention.
Figure 2:
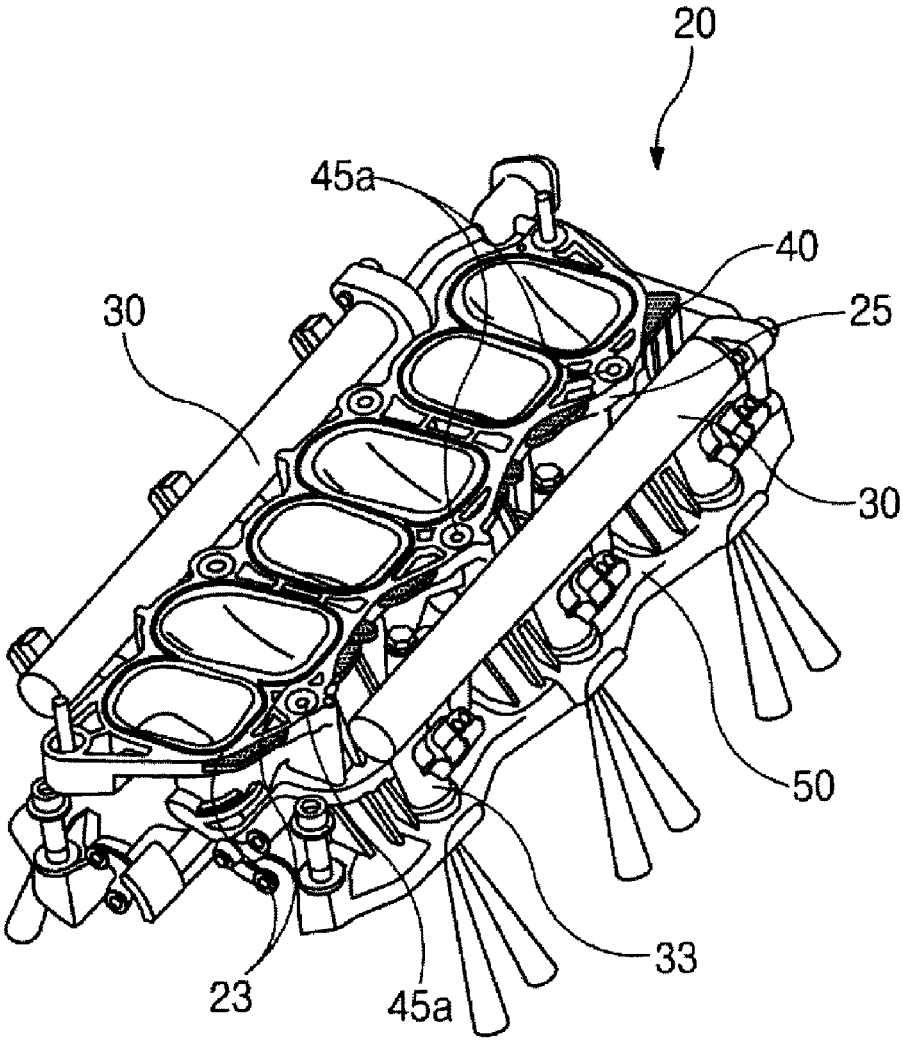
FIG. 2 is a perspective view illustrating an intake manifold in FIG. 1.

FIG. 1 is a perspective view illustrating an intake system of an engine for a vehicle according to various embodiments of the present invention, and FIG. 2 is a perspective view illustrating an intake manifold in FIG. 1.

As illustrated in FIGS. 1 and 2, an intake system 1 of an engine for a vehicle according to various embodiments of the present invention includes a surge tank 10 for inflow of an external air, and an intake manifold 20 connected with the surge tank 10 to guide the external air into each combustion chamber of each cylinder.

The surge tank 10 is connected in a body with the intake manifold 20 by fastening members 45 such as bolts at specified positions.

At a lower end portion of the surge tank 10, a flange 15 is formed to be in contact with a flange 25 of the intake manifold 20 so that the flanges 15 and 25 are fastened by the fastening members 45.

The intake manifold 20 includes a main body 50 on which intake ports 23 corresponding to the respective cylinders are formed, and a guide member 40 provided on the main body 50 to guide the surge tank 10, which separates from the intake manifold 20 when vehicle collision occurs, in a direction where the surge tank 10 becomes more distant from a fuel rail 30.

In the respective intake ports 23, injectors 33 for injecting fuel into the respective combustion chambers are installed.

In front and in the rear of the intake manifold 20, fuel rails 30 for supplying fuel into the respective combustion chambers are arranged, and fuel stored in the fuel rails 30 is injected into the respective combustion chambers through the injectors 33.

Here, at an upper end portion of the main body 50, the flange 25 is formed to be in contact with the flange 15 of the surge tank 10, and fastening holes 45*a*, through which the fastening members 45 pass, are formed on the flange 25.

In this case, a guide member 40 is provided on the flange 25 of the main body 50. When vehicle collision occurs, the surge tank 10 separates from the intake manifold 20 and moves forward by the repelling force, and the guide member 40 guides the surge tank 10 in a direction where the surge tank 10 becomes more distant from the fuel rail 30 to prevent the damage of the fuel rail 30.

Since the fuel rail 30 is arranged on the lower side of the flange 25, it is preferable that the guide member 40 is installed to be upwardly inclined at a specified angle θ (See FIG. 5) against the flange 25. Accordingly, even if the surge tank 10 is separated from the intake manifold 20 and moves forward, it is guided upward by the guide member 40, and thus it does not hit the fuel rail 30 to prevent the damage of the fuel rail 30.

Here, the angle θ of the guide member 40 is set to about 30°. However, the angle may be differently set in accordance with the existing conditions such as the layout inside the engine room and so on.

Now, the principle of preventing the damage of the fuel rail 30 through the intake system 1 of an engine for a vehicle according to various embodiments of the present invention will be briefly described with reference to FIGS. 3 to 5.

Figure 3:
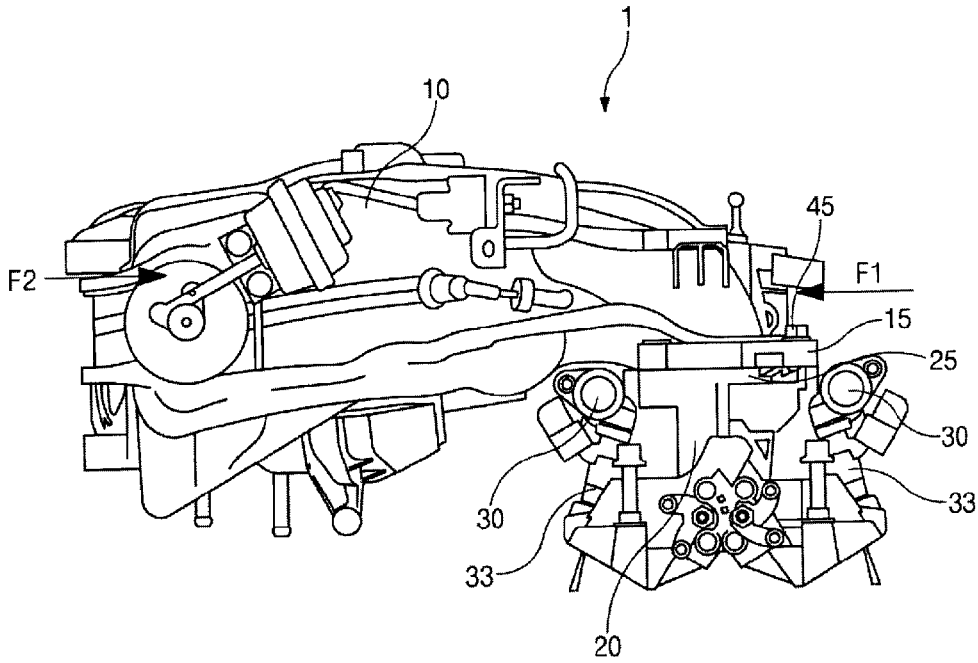
FIGS. 3 to 5 are side views explaining the principle of moving the surge tank in a direction where the surge tank becomes more distance from the fuel rail when vehicle collision occurs.

First, FIG. 3 is a side view illustrating the state where the surge tank 10 and the intake manifold 20 are connected together by the fastening members 45. In this case, the connection force of the fastening members 45 is enough to prevent the surge tank 10 and the intake manifold 20 from being separated from each other when the vehicle is operated.

However, if the vehicle collision occurs and the engine is pushed in F1 direction (i.e. rearward), the dash panel, due to the repelling force, pushes the surge tank 10 in F2 direction.

Figure 4:
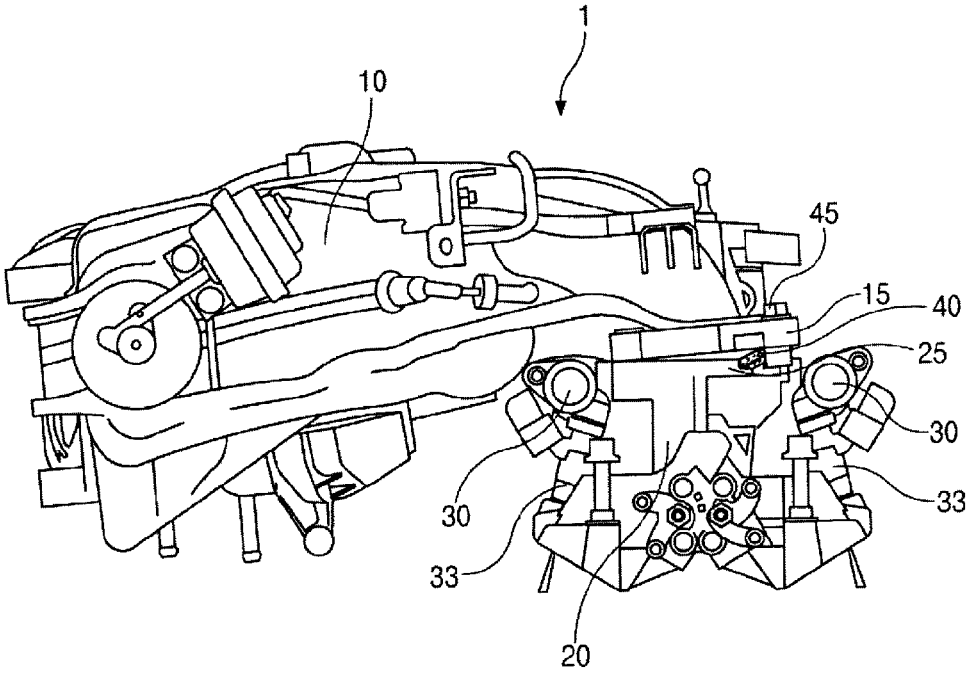

Accordingly, the connection force between the surge tank 10 and the intake manifold 20, which are connected together by the fastening members 45, is weakened, as illustrated in FIG. 4, and the surge tank 10 and the intake manifold 20 are separated from each other, resulting in that the surge tank 10 is further pushed forward by the pressing force of the dash panel.

Figure 5:
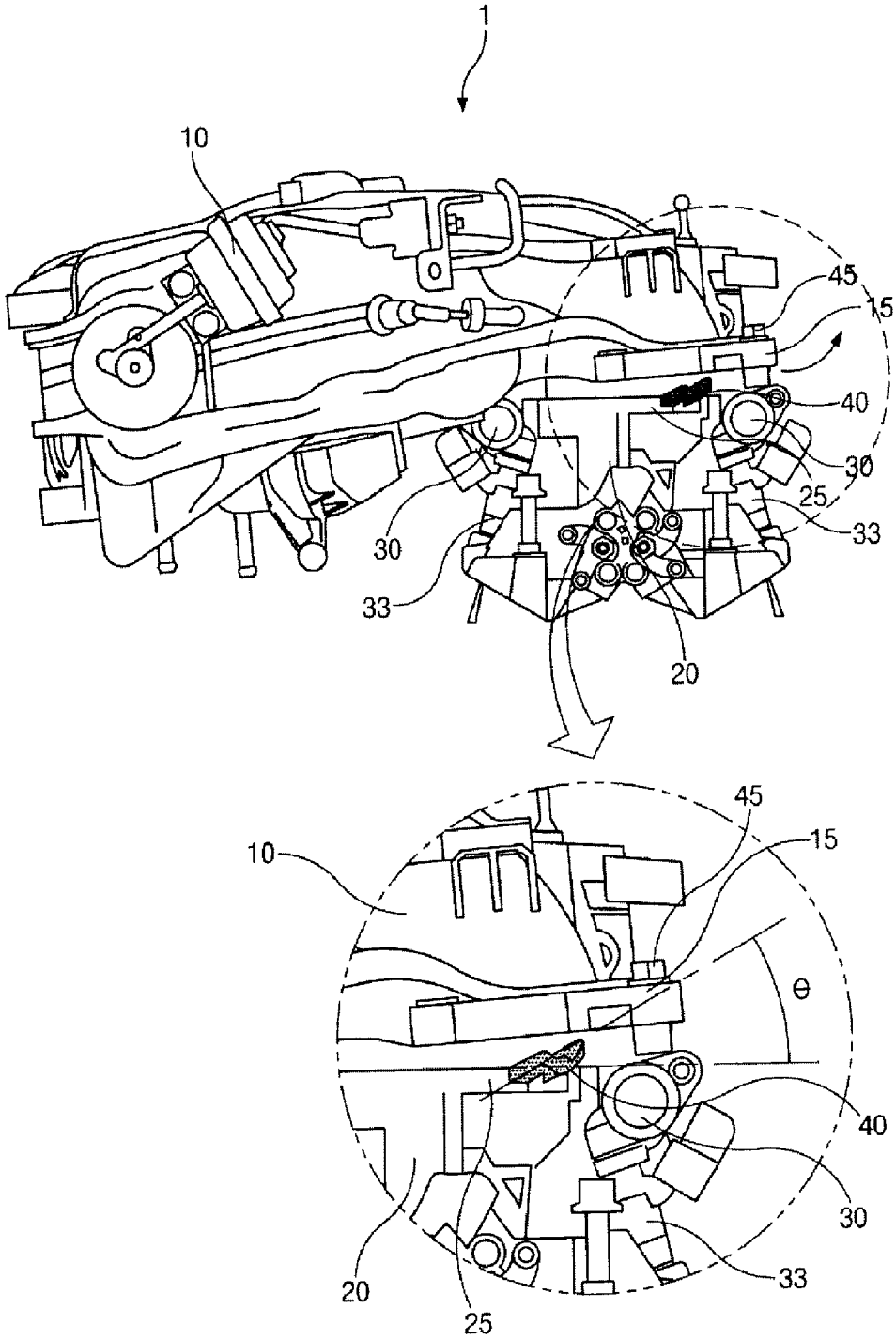

Then, as illustrated in FIG. 5, the surge tank 10 moves upward over the guide member 40 as it collides with the guide member 40, and becomes more distant from the fuel rail 30 to prevent the damage of the fuel rail 30.

As described above, according to the present invention, the surge tank 10, which separates from the intake manifold 20 when vehicle collision occurs, is guided to become more distant from the fuel rail 30, and thus the damage of the fuel rail 30 can be prevented.

For convenience in explanation and accurate definition in the appended claims, the terms "upper", "lower", "front", "rear", and "forward" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An intake manifold of an engine for a vehicle, comprising:

a main body including a fuel rail and intake ports corresponding to cylinders; and a guide member provided on the main body to guide a structure coupled with the main body in a direction where the structure becomes separated and more distant from the fuel rail when vehicle collision occurs; and wherein the guide member is installed at a predetermined angle of inclination on a flange formed at an upper portion of the main body.

2. The intake manifold of claim 1, wherein the fuel rail is positioned lower than the flange, and the guide member is upwardly inclined against the flange.

3. The intake manifold of claim 1, wherein the guide member is installed along a front portion of the flange in a forward direction of the vehicle.

4. The intake manifold of claim 3, wherein the guide member installed on the flange is disposed in front of a front lower portion of the structure and a top portion of the guide member is disposed higher than the front lower portion of the structure so that the structure moves along the guide member upwards when the vehicle collision occurs.

5. The intake manifold of claim 4, wherein a top portion of the guide member is disposed higher than the fuel rail.

6. The intake manifold of claim 1, wherein the guide member installed on the flange is disposed in front of a front lower portion of the structure and a top portion of the guide member is disposed higher than the front lower portion of the structure so that the structure moves along the guide member upwards when the vehicle collision occurs.

7. The intake manifold of claim 1, wherein a top portion of the guide member is disposed higher than the fuel rail.

8. An intake system of an engine for a vehicle, comprising:

a surge tank including a first flange; and an intake manifold including a second flange connected with the first flange of the surge tank, the intake manifold including:

a main body including a fuel rail and intake ports corresponding to cylinders; and a guide member provided on the main body to guide the surge tank coupled with the main body in a direction where the surge tank becomes separated and more distant from the fuel rail of the intake manifold when a vehicle collision occurs; and wherein the guide member is installed at a predetermined angle of inclination on the second flange formed at an upper portion of the main body.

9. The intake manifold of claim 8, wherein the guide member installed on the second flange of the intake manifold is disposed in front of a front lower portion of the first flange of the surge tank and a top portion of the guide member is disposed higher than the front lower portion of the first flange so that the surge tank moves along the guide member upwards when the vehicle collision occurs.

10. The intake manifold of claim 8, wherein the fuel rail is positioned lower than the second flange, and the guide member is upwardly inclined against the second flange in a forward direction of the vehicle.

11. The intake manifold of claim 8, wherein the guide member is installed along a front portion of the second flange in a forward direction of the vehicle.

12. The intake manifold of claim 8, wherein a top portion of the guide member is disposed higher than the fuel rail.

13. The intake system of claim 8, wherein the surge tank and the intake manifold are fastened by fastening members in predetermined positions.

* * * * *